United States Patent [19]

Holtz

[11] Patent Number: 4,715,155

[45] Date of Patent: Dec. 29, 1987

[54] KEYABLE COMPOSITE JOIST

[76] Inventor: Neal E. Holtz, 11400 Rockville Pike, #750, Rockville, Md. 20852

[21] Appl. No.: 947,222

[22] Filed: Dec. 29, 1986

[51] Int. Cl.[4] ..... E04C 3/08

[52] U.S. Cl. ..... 52/333; 52/334; 52/650; 52/694

[58] Field of Search ..... 52/333, 334, 335, 336, 52/338, 690, 694, 695, 326, 340, 650, 327

[56] References Cited

U.S. PATENT DOCUMENTS

| | | | |
|---|---|---|---|
| 1,936,147 | 11/1933 | Young | 52/334 |
| 1,941,211 | 12/1933 | Inglee | 52/326 |
| 3,307,304 | 3/1967 | Klausner . | |
| 3,819,143 | 6/1974 | Butts et al. . | |
| 3,841,597 | 10/1974 | Butts et al. . | |
| 3,845,594 | 11/1974 | Butts | 52/334 |
| 3,861,634 | 1/1975 | Hodd et al. . | |
| 3,945,168 | 3/1976 | Butts et al. . | |
| 3,979,868 | 9/1976 | Butts et al. . | |
| 4,015,396 | 4/1977 | Butts et al. . | |
| 4,080,712 | 3/1978 | Weber . | |
| 4,454,695 | 6/1984 | Person . | |
| 4,455,269 | 6/1984 | Spamer et al. . | |
| 4,549,381 | 10/1985 | Holtz . | |
| 4,584,815 | 4/1986 | Haven et al. . | |
| 4,660,341 | 4/1987 | Holtz | 52/326 |

FOREIGN PATENT DOCUMENTS

| | | | |
|---|---|---|---|
| 2354694 | 6/1974 | Fed. Rep. of Germany | 52/694 |

OTHER PUBLICATIONS

Hodges, Philip T., "How the Keylock Joist Achieves Composite Action", May 19, 1986, 2 pgs.

*Primary Examiner*—John E. Murtagh

*Attorney, Agent, or Firm*—Pollock, Vande Sande & Priddy

[57] ABSTRACT

The present invention provides apparatus for composite slab construction, comprising an open web of zig-zag structure upper and lower knuckles and at least one chord united to the web to form a joist. The chord will include an upper chord comprising a sealing first bar which extends longitudinally in said joist and which has first bar which extends longitudinally in said joist and which has first and second legs. The first leg is a longitudinal, upright leg with a first face which is upright and confronts one side of the web. The second leg comprises plural longitudinally-spaced leg segments extending longitudinally throughout the length of, open spaces. The second bar extends longitudinally in said joist and includes an upright third leg having a second face which is upright and confronts the other side of the web. This second face is laterally spaced from the first leg and is in closely spaced or abutting relationship with the leg segments of the first bar. Together, the first, second and third legs and leg segments and their respective faces form a concrete-receiving channel into which a plurality of the upper knuckles of the web extend to partition the channel into plural, longitudinally spaced pockets having open upper mouths for receiving concrete. Spanner bars extend between adjacent joists.

14 Claims, 8 Drawing Figures

KEYABLE COMPOSITE JOIST

This invention relates to floor and roof constructions, and more particularly, to composite open web steel joist and concrete floor and roof constructions, and to methods of erecting formwork for pouring a slab in place on steel joists.

BACKGROUND OF THE INVENTION

In some methods of constructing floors and roofs, steel joists are placed in position spanning structural supports therefor. The joists support panels, such as plywood sheets, which form the bottom member of a mould, and concrete is poured on the panels to form a slab. It is desirable to be able to reuse the panels after the concrete has hardened and the forms removed. This requires that the forms be supported in such a way that they can be removed with little or no damage to them, and the prior art teaches a variety of techniques for supporting forms in such a way that they can be removed. However, some of the methods are not applicable to open web joist systems; some, which may be used with open web joist systems, are difficult to use in practice; some of the systems may raise safety questions; and some of these systems may not permit an extensive span between adjacent joists.

In one type of system, metal bars, referred to herein as spanner bars, extend between adjacent joists and provide support for the concrete forms. The prior art methods of supporting the spanner bars at the joists, especially at open web joists, can present problems in assembly, disassembly, adjustability, adaptability to a variation in joist structure, and safety.

SUMMARY OF THE INVENTION

The present invention provides apparatus for composite slab construction, comprising an open web of zig-zag structure with slanted bracing members, upper and lower knuckles and open spaces between the bracing members, as well as at least one chord united to the web to form a joist. The chord(s) may or may not include a lower chord but will include an upper chord comprising a sealing first bar which extends longitudinally in said joist and which has first and second legs. The first leg is a longitudinal, upright leg with a first face which is upright and confronts one side of the web. The second leg comprises plural longitudinally-spaced leg segments extending longitudinally and laterally from the first leg, into and substantially throughout the length of, open spaces extending between the bracing members and located between adjacent upper knuckles of the web. The second bar extends longitudinally in said joist and includes an upright third leg having a second face which is upright and confronts the other side of the web. This second face is laterally spaced from the first leg and is in closely spaced or abutting relationship with the leg segments of the first bar. Together, the first, second and third legs and leg segments and their respective faces form a concrete-receiving channel into which a plurality of the upper knuckles of the web extend to partition the channel into plural, longitudinally spaced pockets having open upper mouths for receiving concrete and in which the adjoining surfaces of said legs, leg segments, faces and knuckles abut with one another or are sufficiently closely spaced for forming keyed connections between said pockets and a concrete slab.

The present invention can be utilized in a wide variety of modified forms or embodiments, only a few of which will be shown herein. Each embodiment will satisfy one or more, and the most preferred embodiments will satisfy a majority or all, of the following objects, i.e. to provide means and methods for: supporting spanner bars from a joist which permit easy assembly and disassembly of the spanner bars; supporting spanner bars so that they are readily adjustable in a direction perpendicular to the joist to allow for unequal spacing of the joists; supporting spanner bars in such a way that an external force is required to release the bar; erecting formwork for pouring a slab in place on open web joists; for pouring concrete floors and ceilings; providing a composite steel joist and concrete slab system for a roof or floor construction wherein the joists are open web joists and a poured concrete slab extends between adjacent joists and encloses the top portion of the joist; providing an open web joist having a top chord which is readily encased in concrete, thus forming an integral structure with the concrete; and providing a joist top chord and removable forming system that reduces the leakage of concrete through the mould when the slab is cast.

DESCRIPTION OF PREFERRED EMBODIMENTS

Figures 1, 2:
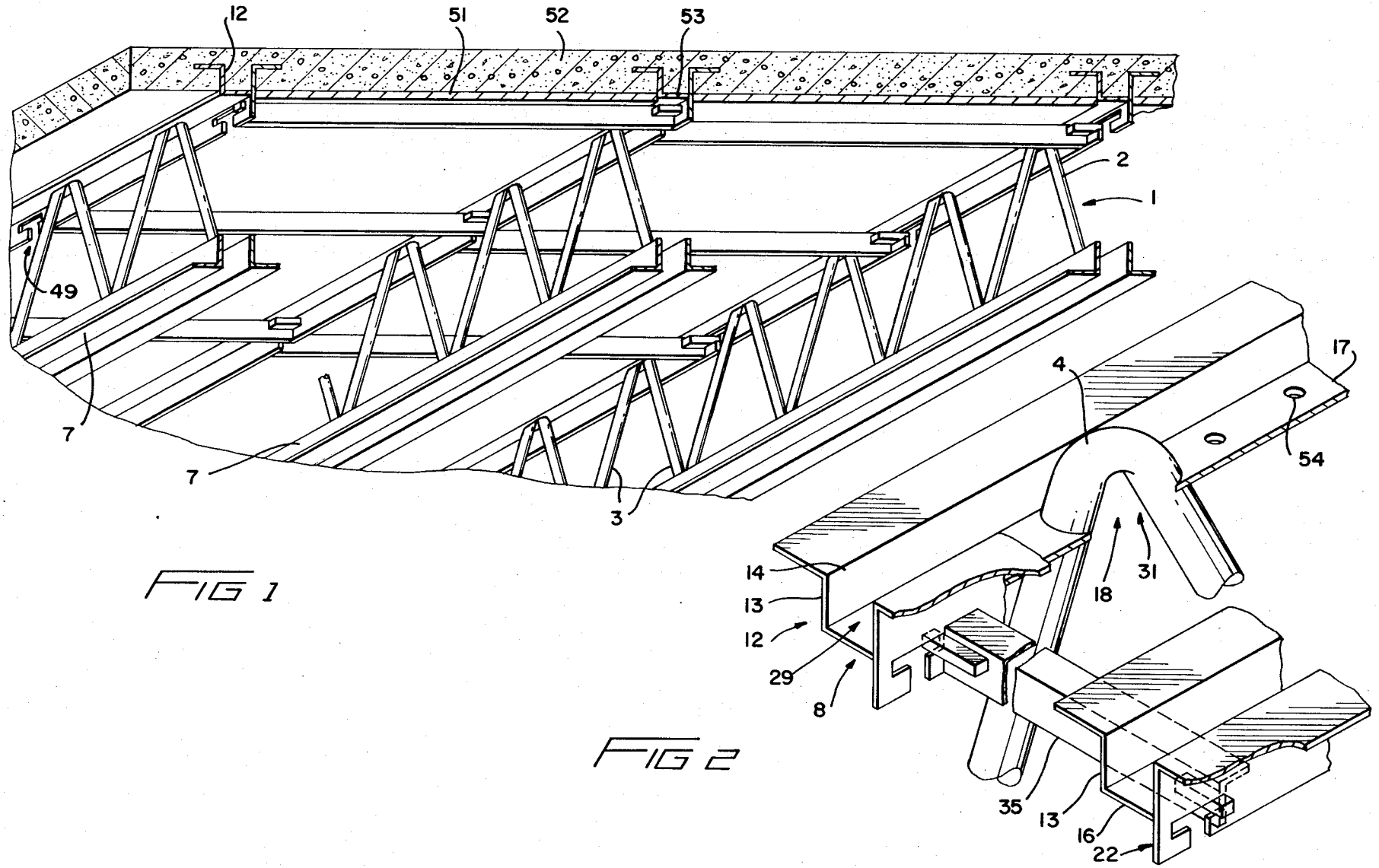
FIG. 1 is a perspective view from beneath a composite concrete slab with joists in accordance with the invention.
FIG. 2 is a perspective view of one of the joists shown in FIG. 1, taken from above, with parts broken out and with the slab being removed.
Figure 3:
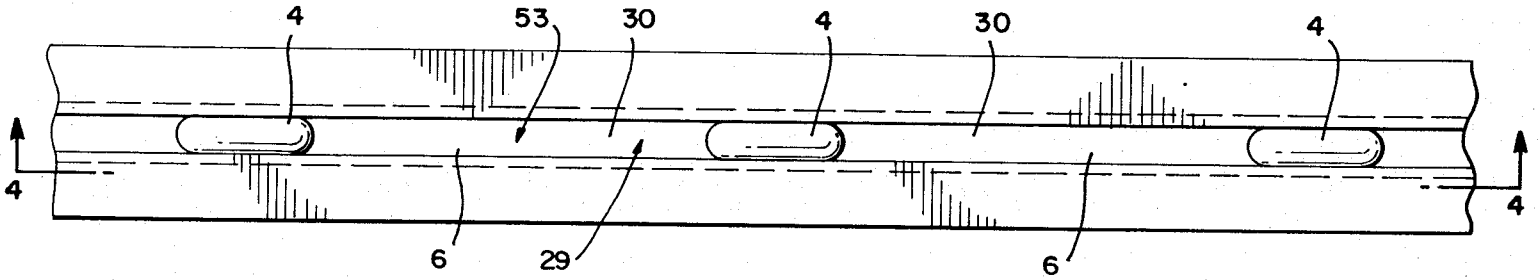
FIG. 3 is a top view of one of the joists of FIG. 1 without the slab.
Figure 4:
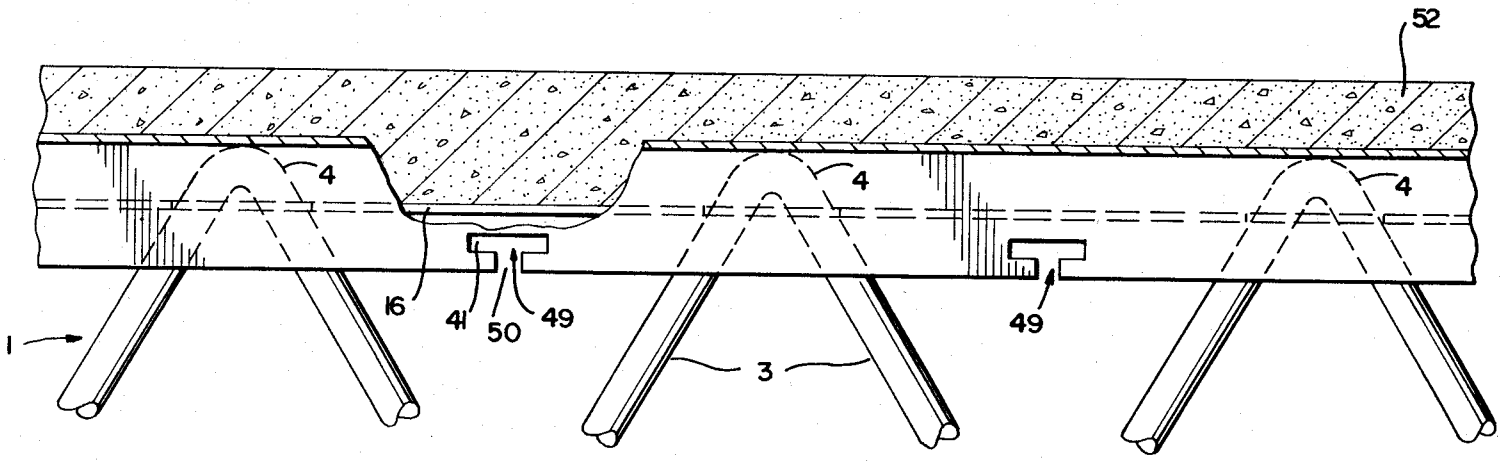
FIG. 4 is a sectional view, with parts broken out, of the joist shown in FIG. 3, with portions of the concrete slab in place.
Figure 6:
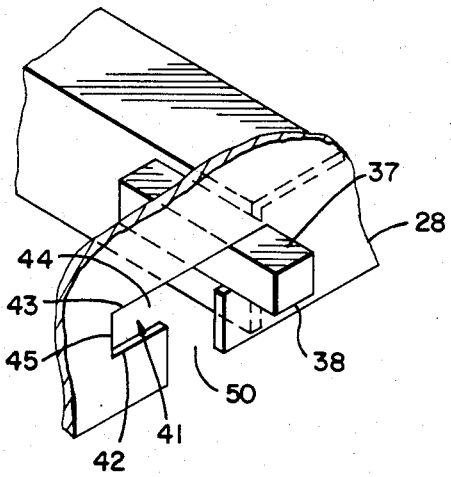
FIG. 6 is a perspective view of a broken out portion of the joist shown in FIG. 5, taken from above, showing details of connecting members and locking sockets.
Figure 5:
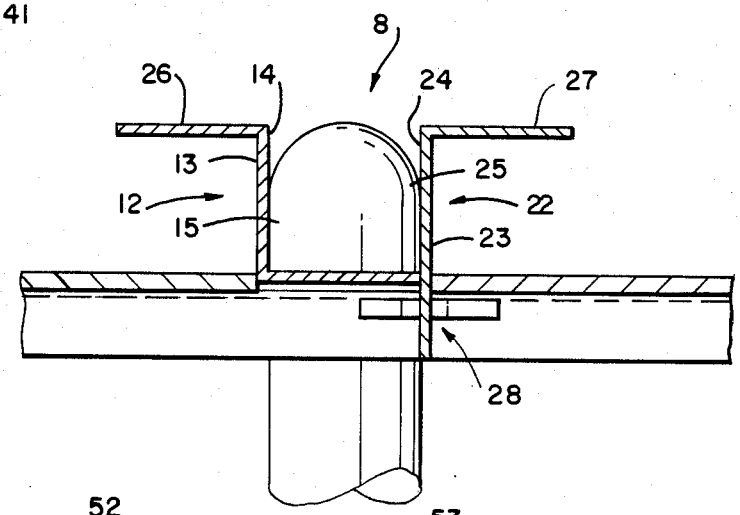
FIG. 5 is a transverse cross section of one of the joists shown in FIG. 1, with the concrete slab removed but with spanner bars in place.
Figure 8:
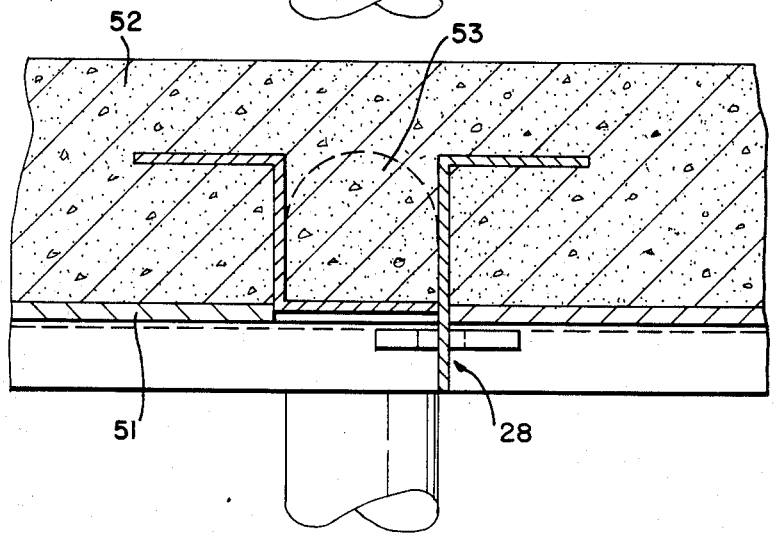
FIG. 8 is similar to FIG. 5, except that the slab is in place.
Figure 7:
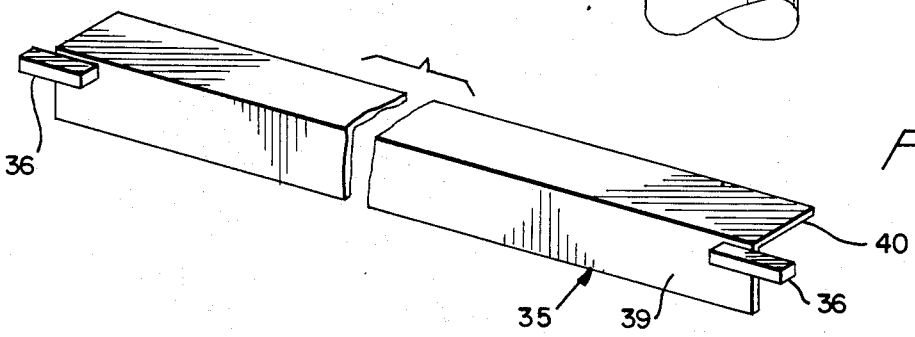
FIG. 7 is a perspective view of one of the spanner bars shown in FIGS. 1 and 5, taken from above.

A preferred embodiment of the invention includes a joist having bracing members which have knuckles and which are supported in a chord or chords. For purposes of the present invention, a knuckle is a structure which includes that portion of the adjoining parts of two adjacent bracing members which approach one another at (including in, on or near) one of the chords. For example, a knuckle may constitute a bend in a continuous length of zig-zag web stock which includes a plurality of bracing members formed from the same piece of material. Alternatively, a knuckle may constitute a zone in which the ends two adjacent bracing members formed from separate pieces of material approach one another, with or without actually making contact with one another.

The bracing members and elements of the chord(s) may be fabricated from bars, some of which include upright components. For purposes of the present invention, a bar is an elongated member of any material, of any transverse or longitudinal cross-section, which may be monolithic or not, and which may be homogeneous or not, provided it conforms to the shape and spatial characteristics discussed herein. Such bars may include only the components discussed herein, or more commonly will include additional component parts which do not prevent operation of the structure in accordance with the invention. Upright, when used in the present description and claims, signifies that a member or specified portion of a member is more nearly vertical than horizontal. More typically the upright components used in the invention are not inclined more than about 20° from the vertical. In most instances, these components will be substantially vertical.

The preferred embodiment disclosed in FIGS. 1–8 of the drawings includes a joist 1 for composite slab construction, comprising an open web 2 of zig-zag structure with slanted bracing members 3 having upper knuckles 4, lower knuckles (not shown), open spaces 6 between the bracing members, and at least one chord united to the web to form a joist. While a lower chord is not always used in such joists, it is preferred that the joist of the present invention include both a lower chord 7 and an upper chord 8, the latter comprising a first sealing bar 12 which extends longitudinally in the joist and has a longitudinal, upright first leg 13 with a first face 14. Face 14 is upright and confronts one side 15 of web 2. A second leg 16 of bar 12 comprises plural longitudinally extending leg segments 17 interspersed with knuckle receiving openings 18. These second leg segments extend longitudinally and laterally from the first leg. Also, they extent into and substantially throughout the length of these portions of open spaces 6 which extend between the bracing members 3 and are located between adjacent upper knuckles 4 of the web.

For purposes of the present disclosure and claims, a segment is one of a series of individual filler members which, as compared to the first leg, and as compared to other segments, may be formed from the same or from a different piece or pieces of material. While adjoining segments are distinct from one another in the sense of being located at opposite ends of knuckle-receiving openings or spaces located between them, they may or may not, but usually will, be connected to one another in some fashion, such as through being integral with the first leg and/or through narrow extensions of the segments extending along the sides of such openings.

Upper chord 8 also includes a second bar 22 which extends longitudinally in the joist and includes an upright third leg 23 having a second face 24. Face 24 is upright and confronts the other side 25 of web 2. Second face 24 is also laterally spaced from first leg 13 and is in closely spaced or abutting relationship with the second leg segments 17 of first bar 12.

The invention is not limited to using first and second bars having the specific configurations shown in the drawings. However, these shapes are particularly advantageous and are thus preferred embodiments for a number of reasons which will be described below.

Preferably the sealing first bar(s) of said joist(s) comprises an angle bar of double L cross-section extending longitudinally in the upper chord. A bar of double L cross-section has integrally formed central web, upper flange and lower flange portions extending longitudinally in said bar with the upper and lower flange portions extending laterally in opposite directions at upper and lower elevations on the central web portion when viewed in transverse cross-section with the central web portion vertically disposed.

When a double L bar is employed, it is preferably arranged so that its central web portion constitutes or corresponds with first leg 13. To the central web portion are attached an upper flange portion 26 and a lower flange portion which constitutes or corresponds with the leg segments 17 of second leg 16 and extends toward third leg 23. These segments remain attached to the central web portion after removal of material from the lower flange portion to form the knuckle-receiving openings 18 at longitudinally spaced intervals along said lower flange portion. These openings can be formed simultaneous with the formation of the second bar by cold rolling the bar stock with an angle forming roll having an integral punch to form the openings.

The widths of openings 18 may correspond with or be smaller than the widths of the second leg segments, so that the above-mentioned leg segments may be entirely separate from one another, such as when the web thickness and opening widths correspond with the widths of the segments as shown in FIG. 2. Alternatively, the segments may be connected by continuations of the segments which extend along one or both sides of the openings, such as when the widths of the segments are greater than the web thickness and opening widths.

Preferably, the second bar(s) of said joist(s) comprises an angle bar of L cross-section extending longitudinally in said upper chord. For purposes of the present invention, a bar of L cross-section has integrally formed upright main web and lateral flange portions, both of which extend longitudinally in said bar. When a bar of L cross section is utilized as the second bar of the joist, its main web portion preferably is or includes the third leg 23 of the joist, to which is connected lateral flange portion 27.

When the main web portion is sufficient height, it can include a longitudinally extending portion 28 of said third leg which is disposed below the second leg segments 17 of the first bar is or includes an integrally formed portion of the main web portion. The presence of the longitudinally extending portion 28 in the upper chord reduces the criticality of respectively maintaining the upper flange portion and the lateral flange portion of the first and second bars 12 and 22 at identical elevations during assembly of the upper chord, by providing a sufficient vertical expanse for the leg segments 17 to closely approach or abut against despite differences in such elevations.

Forming the upper chord from L and double L angle stock permits construction of the joist from readily available shapes by familiar and conventional fabrication procedures, eliminating the need for using special Z or S cross-section bars and the special fabrication techniques which their use entails. The herein-described preferred embodiment of the invention and various alternative forms thereof can be successfully fabricated by easily made modifications to the commodity bar joists which are manufactured by over four dozen companies in the U.S. The required bars can be fabricated in cold roll presses and then integrated into a standard joist. The process of integration or assembly can be and frequently is done essentially by hand in a series of "lines". Each line consists of a number of welding personnel standing side by side, and they weld the upper and lower cords to the zig zag web members, as these components pass along the fabrication line, thus forming a completed joist.

As indicated above, the first, second and third legs and leg segments and their respective faces form a concrete-receiving channel 29 into which a plurality of the web upper knuckles 4 extend to partition the channel into plural, longitudinally spaced pockets 30 having open upper mouths for receiving concrete. In these pockets, the adjoining surfaces of said legs, leg segments, faces and knuckles abut with one another or are sufficiently closely spaced for forming keyed connections between concrete in said pockets and in the remainder of a concrete slab, or, more preferably, for forming such connections and effectively inhibiting the flow of wet concrete out of the bottom of said channel.

While having a portion of the third leg extend below the second leg segments can cause the elevations of the bottom edges of the first and third legs to be at different elevations from one another, thus tending to complicate or prevent application of temporary concrete seals to the underside of the chord, these are made unnecessary by the second leg segments. Thus, the above-described special top chord design controls falling of concrete from between the two top angles without need to taping or otherwise closing the space at the top of the chord (with consequent loss of keying capabilities) and without need for an extra step of applying to the underside of the chord special temporary seals which do permit keying but have occasionally impaired keying by falling off during the pouring of concrete. This avoids messiness (with ensuing cleanup requirements and expense) while providing an opportunity for proper key formation with ensuing good shear transfer between the concrete and the joist.

Preferably, longitudinally extending portion 28 of hangar bar 22 has supporting means for receiving and supporting the ends of spanner bars. For example, one may employ a spanner bar 35 of L or other suitable cross-section which may be equipped with connecting members 36. Such connecting members are optional, since some supporting means configurations may not require a specific connecting member. When a connecting member is employed, it will be adapted by its structure to connect with the supporting member, preferably in closely abutting relationship with at least one and preferably two or more corresponding surfaces(s) of the supporting means. In one acceptable and particularly preferred embodiment the connecting member is a projecting member having planar parallel sides 37,38 and a square or rectangular cross-section. Such a connecting member may be affixed to spanner bar 35 in any suitable manner, such as by welding a stub of bar stock to the convex outer surface 39 of the spanner bar (as shown) and/or to the concave inner surface 40 of the spanner bar. Alternatively, the projecting connecting member may be formed by cutting away parts of the bar stock from which the spanner bar is fabricated.

The supporting means may be of any configuration, including projections, depressions, openings, slots of various types which are and are not openings in the longitudinally extending portion of the third leg, and other configurations. Such supporting means is preferably formed in such a manner as to require an external force to release spanner bars supported thereby, and preferably includes locking sockets 41. For purposes of the present invention a locking socket is a structure with wall means for engaging, in closely abutting relationship, one or more corresponding surfaces at (including in, on or near) the end of the spanner bar (including the gripping of a projecting connecting member present at the end of the spanner bar) for effectively preventing downward and rotational movement of the end of the spanner bar. A locking socket of the present embodiment preferably includes a pair of parallel, straight walls 42, 43 which confront one another across an open or unobstructed space 44 defining a concave structure for receiving the end of the spanner bars. Preferably, the locking sockets have parallel, substantially horizontal straight upper and lower walls. More preferably the length of the lower, and preferably of both of the upper and lower walls, is at least as great, and preferably is greater, than that of the corresponding surfaces at the ends of the spanner bars. It is advantageous if the locking socket is arranged to provide at least one degree of freedom of movement for the spanner bar ends in a horizontal direction.

Preferably the parallel, straight walls are arranged to provide at least one degree of freedom of movement for the spanner bar ends in a horizontal direction running generally parallel to the direction of longitudinal extension of the third leg of the joist. More preferably, each locking slot provides only a single longitudinal degree of freedom of the kind described, e.g. the slot has an end wall 45 at one end which serves as a stop for the connecting member. Each locking socket 41 may be sized to engage one or a plurality of spanner bar ends 36 in any of the above-described ways.

Although the above-described open or unobstructed space defining a concave structure for receiving the end of the spanner bar may or may not constitute an opening passing through the entire thickness of the longitudinal extension of the third leg of the joist, it is advantageous if it does so. Such an arrangement facilitates adjustment of the positions of spanner bars in a direction perpendicular to the joist to allow for unequal spacing of the joists. The requisite opening may for example be formed when fabricating the hanger bar by cold rolling the bar stock with an angle forming roll having an integral punch to form the openings.

The above described support means may include escape passages adjacent to and in communication with the locking sockets. For purposes of the present invention, an escape passage is an element of the joist which provides a path for removal of the spanner bar ends from the locking sockets, including any configuration of depressions, openings, slots of various types which are and are not opening passing entirely through the longitudinally extending portion of the third leg and other configurations. Such element may or may not represent a fully formed passage and path in the joist as manufactured, an example of the latter being a knock-out area formed in the longitudinally extending portion of the third leg adjacent to and in communication with the locking sockets, such knock-out area being intended to be removed from the joist by impact and/or bending after installation of the spanner bars and casting of a concrete slab. For purposes of the present invention, removal refers to separation of spanner bars from a joist by movement of the bars in any direction compatible with the shapes and positions of the spanner bars, spanner bar ends, locking slots and escape passages. For example, such removal may occur in a horizontal direction running generally perpendicular to the direction of longitudinal extension of the third leg of the joist. Preferably, such removal will occur in a direction which is more nearly vertical than horizontal, for example, and most preferably, in a downward direction generally perpendicular to the direction of extension of the third leg. One or more locking sockets can be served by the same escape passage; for example, an escape passage may be located between and serve each of two locking sockets.

Preferably the apparatus includes open escape passages extending through a lower edge of the third leg for removal of the spanner bar end therefrom. For purposes of the present invention, an open escape passage is one which is fully formed in the joist as manufactured, i.e it is not necessary to displace a knock-out area to complete the passage. According to a particularly preferred embodiment, the support means includes a plurality of longitudinally spaced apertures 49 in the integrally formed portion of the third leg. These apertures include locking sockets for receiving the ends of spanner bars, for gripping said ends and for preventing rotation of said spanner bars about their longitudinal axes, and said apertures extend through a lower edge of said integrally formed portion for removal of the spanner bar ends therefrom. In the most preferred embodiment apertures 49 comprise two locking sockets 41*a* and 41*b* communicating with a common open escape passge 50 and each constitute a single T-shaped aperture, in which the sockets are the two arms of the upper bar of the T and the escape passage is the shank of the T. Such an arrangement permits easy assembly and disassembly of the supporting member and the spanner bars, especially when a plurality of such apertures are provided in the second bar above each of a plurality of lower knuckles.

Thus, one particularly preferred embodiment, among many possible variations of this invention, includes an open web steel bar joist having a top chord, a bottom chord, and an open web joining and separating said top chord and said bottom chord. Said top chord comprises two bars. The first bar of the top chord has: a vertical first leg that provides much of the strength of this part of the top chord and that provides a surface whereby the top chord can be welded to the web members; and a second horizontal leg that is notched to form segments which reach over to the other part of the top chord while allowing the web knuckles to come up between the two parts of the top chord and that can restrain wet concrete within the top chord; and may optionally have another horizontal section providing additional strength and stability to the top chord. The second bar of the joist top chord has: a vertical third leg, parts of which extend both above and below the notched horizontal second leg in the first bar of the top chord and has cut-outs below the second leg to accept spanner bar ends while providing much of the strength of this part of the top chord and further providing a surface whereby the top chord can be welded to the web members; and may optionally have a horizontal section providing additional strength and stability in the top chord.

A plurality of joists 1 corresponding to any of the possible embodiments of the invention are usefully combined in a construction assembly which also comprises spanner bars supported by the support means of said joists. Such construction assemblies also include concrete casting panels 51 supported on said spanner bars for casting the underside of a slab of concrete 52.

In an illustrative method of practicing the invention, the above-described, preferred open web steel joists are placed on supports in accordance with conventional construction practice. However, in view of the use of spanner bars, the joists can be spaced further apart than is typical for construction not using spanner bars. Spanner bars are then inserted in the apertures in the hanger bars of the top chord, concrete casting panels are laid on top of the spanner bars, reinforcement for the concrete is put in place, and the concrete is poured. After the concrete has set, and has sufficient strength to support itself, the spanner bars are removed and the mould panels are stripped from the bottom of the concrete slab.

With exercise of care to insure proper compaction and filling in of concrete in and around the above-mentioned pockets and around their top chords, a plurality of said joists are particularly useful for forming, in combination, a keyed composite slab and joist assembly which comprises the concrete slab 52, simultaneously cast portions of which surround and embed portions of the upper chords 8 of said joists and include keys 53. These keys extend into the above-mentioned pockets for keying the slab to the joist and transferring shear stresses between the slab and the joist. For verifying formation of such keys, the second leg segments may include key inspection apertures 54 formed in one or more of the legs, leg segments and faces forming said concrete-receiving channel(s).

Provision and use of the pockets 30 to key joists to slabs in a composite arrangement provides an effective means for shear transfer between the slab and the joist, thereby eliminating any need for projection of the upper web knuckles 34 above the upper flanges of the first and second bars, as well as any need for specially shaped chord bars which project above the top of the web. As compared to joists having such projecting chord bars, this arrangement permits upper flanges of the upper chords of the joists to be centrally positioned vertically in a concrete slab of a given thickness while also providing effective shear transfer. When this reduces the height needed between floors to accommodate the composite joist system, substantial cost savings can be realized. For example, in a 15 story building, if the height savings were 2" per floor for a total of 30", 30" of exterior skin could be eliminated from the construction cost. Assuming a building surface length of 600 linear feet and a saving in skin area of 1,500 sq. ft. at a cost of $40.00 per sq. ft. for granite at typical present cost levels, the total savings would amount to $60,000.00. Thus, it is a preferred embodiment of the invention that upper knuckles 34 are positioned within the upper chord(s) of said joist(s) at substantially the same elevation as, and not substantially above, said first and third legs 13 and 23.

I claim:

1. A joist for composite slab construction, comprising:

a. an open web of
  i. zig-zag structure with
    (1) slanted bracing members and
    (2) upper and lower knuckle and
  ii. open spaces between the bracing members, and
b. at least one chord united to the web to form a joist, including
  i. an upper chord comprising
    (1) a sealing first bar which
      (a) extends longitudinally in said joist (b) and which has
      (i) a longitudinal, upright first leg havng a first face which is
      (1)upright and
      (2)confronts one side of the web
      (ii) a second leg comprising plural longitudinally-spaced leg segments extending (1) longitudinally and laterally from the first leg, (2) into and substantially throughout the length of, open spaces extending between the bracing members and located between adjacent upper knuckles of the web, and (2) a second bar, which (a) extend longitudinally in said joist (b) and includes an upright third leg having (i) a second face which (1) is upright (2) confronts the other side of the web (3) is laterally spaced from the first leg and (4) is in closely spaced or abutting relationship with the leg segments of the first bar, (3) said first, second and third legs and leg segments and their respective faces forming a concrete-receiving channel (a) into which a plurality of the upper knuckles of the web extend to partition the channel into plural, longitudinally spaced pockets having open upper mouths for receiving concrete and (b)in which the adjoining surfaces of said legs, leg segments, faces and knuckles abut with one another or are sufficiently closely spaced for forming keyed connections between said pockets and a concrete slab.

2. Apparatus according to claim 1 wherein said second bar is a hanger bar and also includes a longitudinally extending portion disposed below the leg segments of the first bar and having supporting means for receiving and supporting the ends of spanner bars.

3. Apparatus according to claim 2 wherein a plurality of said joists are combined in a construction assembly which also comprises: spanner bars supported by the support means of said joists; and concrete casting panels supported on said spanner bars for casting the underside of a slab of concrete.

4. Apparatus according to claim 2 wherein a plurality of said joists are combined in a keyed composite slab and joist assembly which also comprises a concrete slab, simultaneously cast portions of which surround and embed portions of the upper chords of said joists and include keys which extend into said pockets for keying the slab to the joist and transferring shear stresses between the slab and the joists.

5. Apparatus according to claims 1, 2, 3 or 4 including key inspection apertures formed in one or more of the legs, leg segments and faces forming said concrete-receiving channel(s).

6. Apparatus according to claims 1, 2, 3 or 4 wherein said upper knuckles are positioned within the upper chord(s) of said joist(s) at substantially the same elevation as, and not substantially above, said first and third legs.

7. Apparatus accordng to claims 1, 2, 3 or 4 wherein the sealing first bar(s) of said joist(s) comprises an angle bar of double L cross-section having integrally formed central web, upper flange and lower flange portions extending longitudinally in said upper chord with the upper and lower flange portions extending laterally in opposite directions at upper and lower elevations on the cental web portion, the central web portion constituting said first leg and said leg segments being parts of said lower flange portion which extend toward said third leg and which remain attached to the central web portion after removal of material from the lower flange portion to form knuckle-receiving openings at longitudinally spaced intervals along said lower flange portion.

8. Apparatus according to claims 1, 2, 3 or 4, wherein said second bar(s) of said joist(s) comprises an angle bar of L cross-section having an integrally formed upright main web portion and a lateral flange portion both extending longitudinally in said upper chord, said third leg is or includes the main web portion and said longitudinally extending portion or said third leg which is disposed below the leg segments of the first bar is or includes an integrally formed portion of the main web portion.

9. Apparatus according to claims 1, 2, 3 or 4 wherein the sealing first bar(s) of said joist(s) comprises an angle bar of double L cross-section having integrally formed central web, upper flange and lower flange portions extending longitudinally in said upper chord with the upper and lower flange portions extending laterally in opposite directions at upper and lower elevations on the central web portion, the central web portion constituting said first leg and said leg segments being segments of said lower flange which extend toward said third leg and which remain attached to the central web portion after removal of material from the lower flange portion to form knuckle-receiving openings at longitudinally spaced intervals along said lower flange portion, and wherein said second bar(s) of said joist(s) comprises an angle bar of L cross-section having an integrally formed upright main web portion and a lateral flange portion both extending longitudinally in said upper chord, said third leg is or includes the main web portion and said longitudinally extending portion of said third leg which is disposed below the leg segments of the first bar is or includes an integrally formed portion of the main web portion.

10. Apparatus according to claims 2, 3 or 4 wherein the sealing first bar(s) of said joist(s) comprises an angle bar of double L cross-section having integrally fomred central web, upper flange and lower flange portions extending longitudinally in said upper chord with the upper and lower flange portions extending laterally in opposite directions at upper and lower elevations on the central web portion, the central web portion constituting said first leg and said leg segments being segments of said lower flange portion which extend toward said third leg and which remain attached to the central web portion after removal of material from the lower flange portion to form knuckle-receiving openings at longitudinally spaced intervals along said lower flange portion, and wherein said second bar(s) of said joist(s) is a hanger bar which comprises an angle bar of L cross-section having an integrally formed upright main web portion and a lateral flange portion both extending longitudinally in said upper chord, said third leg is or includes the main web portion and said longitudinally extending portion of said third leg which is disposed below the leg segments of the first bar is or includes an integrally formed portion of the main web portion having supporting means for receiving and supporting the ends of spanner bars.

11. Apparatus according to claim 10 wherein said supporting means includes locking sockets for gripping said ends and preventing rotation of said spanner bars about their longitudinal axes.

12. Apparatus according to claim 10 wherein said supporting means includes (a) locking sockets for gripping said ends and preventing rotation of said spanner bars about their longitudinal axes and (b) escape passge adjacent to and in communication with the locking sockets.

13. Apparatus according to claim 10 wherein said supporting means includes (a) locking sockets for gripping said ends, for preventing dropping of said spanner bars and for preventing rotation of said spanner bars about their longitudinal axes and (b) open escape passages adjacent to and in communication with the locking sockets and extending through a lower edge of the third leg for removal of the spanner bar ends therefrom.

14. Apparatus according to claim 10 wherein said supporting means includes a plurality of longitudinally spaced apertures in said integrally formed portion of the third leg, which apertures include locking sockets for receiving the ends of spanner bars, for gripping said ends and for preventing rotation of said spanner bars about their longitudinal axes, and said apertures also include open escape passages adjacent to and in communication with the locking sockets and extending through a lower edge of said integrally formed portion for removal of the spanner bar ends therefrom.

* * * * *